US006422167B1

(12) United States Patent
Bridges

(10) Patent No.: US 6,422,167 B1
(45) Date of Patent: Jul. 23, 2002

(54) APPARATUS AND METHOD FOR ELEVATING A WATERCRAFT OUT OF A BODY OF WATER

(76) Inventor: Gary A. Bridges, 1242 Baywood Cir., Brighton, MI (US) 48116

( * ) Notice: Subject to any disclaimer, the term of this patent is extended or adjusted under 35 U.S.C. 154(b) by 0 days.

(21) Appl. No.: 09/920,127

(22) Filed: Aug. 1, 2001

(51) Int. Cl.[7] ..... B63C 7/00
(52) U.S. Cl. ..... 114/44; 114/45
(58) Field of Search ..... 114/45, 46, 49, 114/52, 53, 263, 264, 357

(56) References Cited

U.S. PATENT DOCUMENTS 2,723,319 A * 12/1955 Engstrand
5,931,113 A * 8/1999 Eva, III et al. ..... 114/263
6,006,697 A * 12/1999 Hillman et al. ..... 114/46

* cited by examiner

*Primary Examiner*—Ed Swinehart
(74) *Attorney, Agent, or Firm*—Law Offices of John Chupa and Associates, P.C.

(57) ABSTRACT

A portable floatation assembly 10 which selectively elevates a watercraft 20 above a water line. The portable floatation assembly 10 includes a plurality of generally hollow body portions 12 having a plurality of boat reception grooves 32 and a plurality of apertures 30 which selectively couples to a plurality of apertures 26 disposed along the periphery of generally flat base members 14 which contain a central aperture 22. Each generally hollow body member 12 and a unique one of the base members 14 cooperates to form a generally hollow cavity 60 within the cooperatively formed floatation devices 44. Portable floatation assembly 10 further includes a plurality of conduits 16 which are coupled to both a pump 18 and the floatation devices 44 through central aperture 22, effective to displace a volume of air within cavity 60 of floatation devices 44, which is effective to selectively and conveniently elevate a watercraft 20 above a water line.

18 Claims, 3 Drawing Sheets

APPARATUS AND METHOD FOR ELEVATING A WATERCRAFT OUT OF A BODY OF WATER

FIELD OF THE INVENTION

The present invention generally relates to an apparatus and a method for selectively elevating a watercraft out of a body of water, and more particularly, to a portable apparatus and a method which selectively and substantially elevates a watercraft out of a body of water in a relatively safe and efficient manner.

BACKGROUND OF THE INVENTION

Floatation devices are used in a wide variety of applications, to selectively provide a predetermined amount of buoyancy in or for a multitude of objects. For example and without limitation, one type of floatation device is adapted to elevate or raise a watercraft out of a body of water in order to conduct repairs on the hull of the watercraft, clean the hull of the watercraft, store the watercraft above a water line to avoid hull damage (e.g., from ice during the winter).

By way of example and without limitation, previous methods and strategies for elevating a watercraft above a water line include physically removing the watercraft from the body of water, physically raising the watercraft out of the water with a mechanical raising assembly, and employing another individual, party, or company to elevate the watercraft. Each of the aforementioned methods and strategies for elevating a watercraft above a waterline has distinct and substantially similar drawbacks.

Particularly, physically removing the watercraft (i.e., pulling the watercraft out of and away from the body of water) often requires a boat trailer, which is relatively expensive and is often customized to transport only a particular type and/or size of watercraft. Removing the watercraft from the water using a trailer also requires a substantially powerful vehicle to pull the loaded boat trailer from the water and necessitates finding and using an inclined boat launch with vehicle accessibility to lower the trailer into a body of water. Additionally, removing a watercraft from a body of water often requires physical strength to manually turn or "crank" a winch assembly to pull and secure the watercraft upon the boat trailer.

Moreover, many watercraft owners that do not possess a permanent location in a relatively shallow body of water may choose to place the watercraft upon a trailer and store the trailer and watercraft at their homes. This strategy requires a relatively large driveway, garage, or yard, which many watercraft owners may not possess. Furthermore, many sub-division/homeowners committees have passed a rule stating that a watercraft may not be stored in a driveway or yard due to their unpleasant or disagreeable appearance, which may force a watercraft owner to rent a storage space in a facility designed to store watercrafts, which may be a relatively far distance from the owner's home, and requires an annual expense.

Elevating a watercraft by placing the watercraft upon a mechanical raising assembly is undesirable in some instances because mechanical raising assemblies are often relatively expensive and non-portable. Mechanical raising assemblies are designed to be anchored semi-permanently to the bottom of a body of water, which necessitates an owned or leased permanent location in a relatively. shallow body of water that many watercraft owners may not possess. Additionally, mechanical raising assemblies are constructed to elevate a particular size and/or shape of watercraft and are not easily adapted to lift different watercraft from the water.

Employing another person or company to raise the watercraft using mechanical or other devices (e.g., using forklifts or cranes to pick up the watercraft for storage or repair) is a costly and continuing expense, and requires the watercraft owner to be limited by the hired person or company's time schedule. Employing other individuals to remove a watercraft from the water also necessitates bringing the watercraft to a particular location and/or requires the hired individual to bring relatively large machinery to the watercraft's current location.

There is therefore a need for a portable apparatus which may be employed to raise a watercraft above a waterline, while permitting the user to conveniently and inexpensively store a watercraft.

There is also a need for a method for elevating a watercraft above a water line, which overcomes some or all of the previously delineated drawbacks of prior watercraft elevating methodologies and strategies.

SUMMARY OF THE INVENTION

A first non-limiting advantage of the present invention is that the present invention provides an apparatus and a method which allows for the elevating of a watercraft above a waterline in a manner which overcomes some or all of the previously delineated drawbacks of prior watercraft elevating methodologies.

A second non-limiting advantage of the present invention is that the present invention provides a portable apparatus which is adapted to elevate a watercraft and which is modular to adapt to various sized watercraft.

A third non-limiting advantage of the present invention is that the present invention provides a portable apparatus which uses compressed air to elevate a watercraft.

A fourth non-limiting advantage of the present invention is that the present invention provides a portable apparatus which is easily disassembled and is stackable in order to reduce storage and transport space.

A fifth non-limiting advantage of the present invention is that the present invention provides a method for selectively and conveniently elevating a watercraft above a waterline.

According to a first aspect of the present invention, a floatation assembly is provided comprising a plurality of substantially identical and rectangular generally hollow bodies, a plurality of substantially identical base portions, a plurality of conduits, and an air pump.

According to a second aspect of the present invention, a portable floatation assembly is provided for selectively elevating a watercraft above a water line, the portable floatation device comprising of a plurality of generally hollow bodies having a curved top surface, a serrated middle portion which frictionally engages said watercraft, and a rim having a plurality of first apertures; a plurality of generally flat base members having a plurality of second apertures; a plurality of connection members having a plurality of third apertures; a plurality of conduits; and a manually powered air pump, effective to elevate a watercraft above a water line.

According to a third aspect of the present invention, a method for elevating a watercraft above a water line is provided, the method comprising the steps of; forming a plurality of stackable and generally hollow body portions; forming a plurality of stackable and generally flat base portions; providing a plurality of conduits; providing a pumping device; coupling said pumping device to said conduits, coupling said conduits to said base portions, and coupling said generally hollow body portions to said base portions, effective to form a plurality of floatation members; placing said plurality of floatation members beneath said hull portion of said watercraft; and causing said pumping device to displace a volume of air into each of said plurality of floatation members, effective to raise said watercraft out of said body of water.

DETAILED DESCRIPTION OF THE PREFERRED EMBODIMENT OF THE INVENTION

Figure 1:
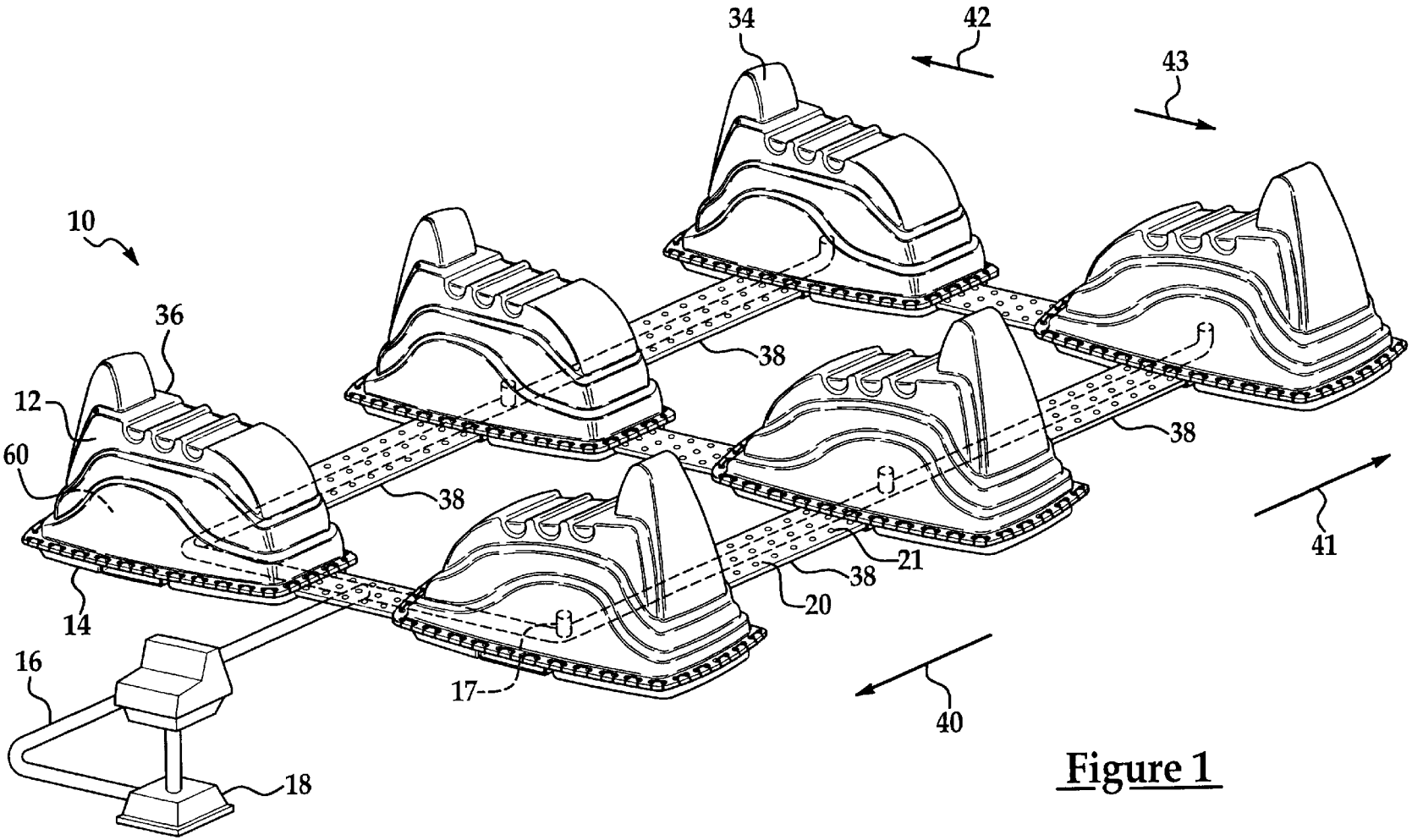
FIG. 1 is a perspective assembled view of a portable floatation assembly which is made in accordance with the teachings of the preferred embodiment of the invention.

Referring now to FIGS. 1–4, there is shown a portable floatation assembly 10 which is made in accordance with the teachings of the preferred embodiment of the invention. As shown, the portable floatation assembly 10 includes a plurality of relatively identical generally hollow body portions 12, which are constructed from a relatively thin, lightweight, and durable material that is gas impermeable. For example and without limitation, body portion 12 may be constructed of an injection molded polymer material. Body portion 12 comprises a generally curved top portion 36 having a plurality of substantially identical grooves or serrations 32 and wall sections 51–53 that cooperatively form an inner hollow portion or cavity 55. Generally hollow body portion 12 further includes a retention member 34, which projects from rear wall 51 substantially orthogonal to top section 36 and which cooperates with grooves 32 to frictionally engage a hull portion 21 of a watercraft 20, effective to hold or contain watercraft 20. Body portion 12 further includes a rim portion 28 which projects out from the bottom edge 27 of body 12. Rim 28 contains a plurality of apertures 30 disposed along the periphery of the rim portion 28.

Figure 3:
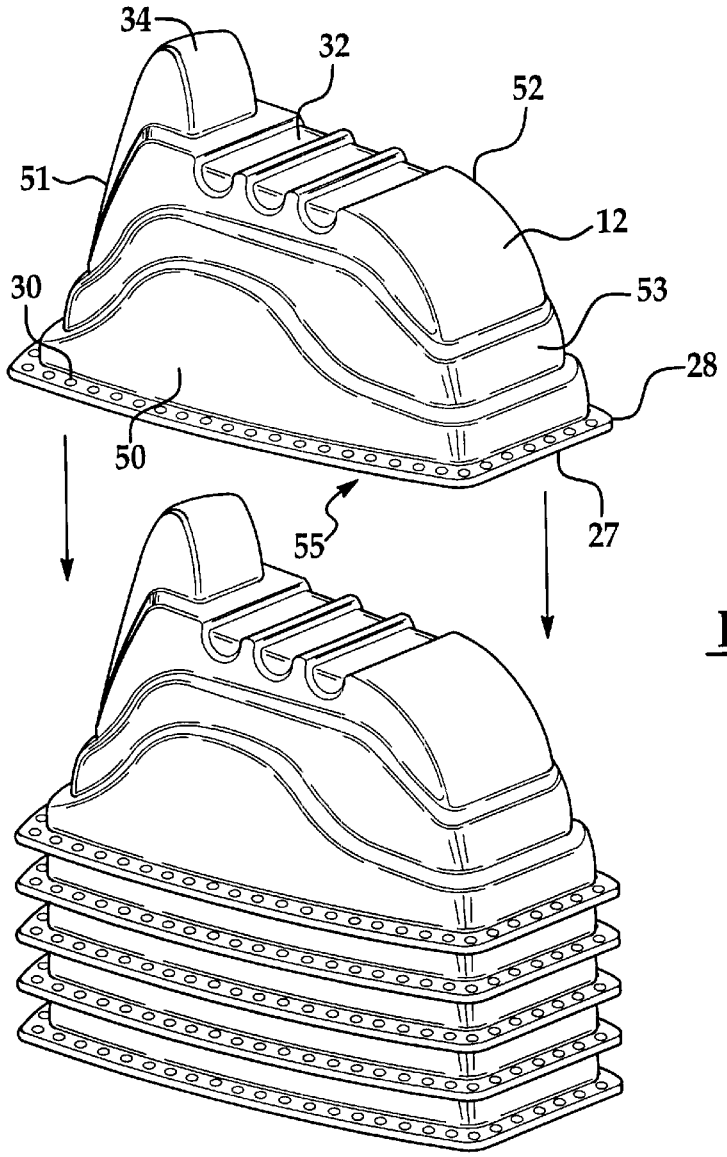
FIG. 3 is a perspective view of a plurality of generally hollow body portions and their respective stacking capability.

Importantly, as best shown in FIG. 3, top portion 36, walls 50–53, retention member 34 and rim 28 are integrally formed to create a gas impermeable shell or generally hollow body 12 that is shaped to permit a user to dispose an individual body 12 over the top of another body 12 by placing generally curved top portion 36 within the hollow opening 55 (i.e., permits a plurality of hollow bodies 12 to be "stacked" upon one another).

Figure 4:
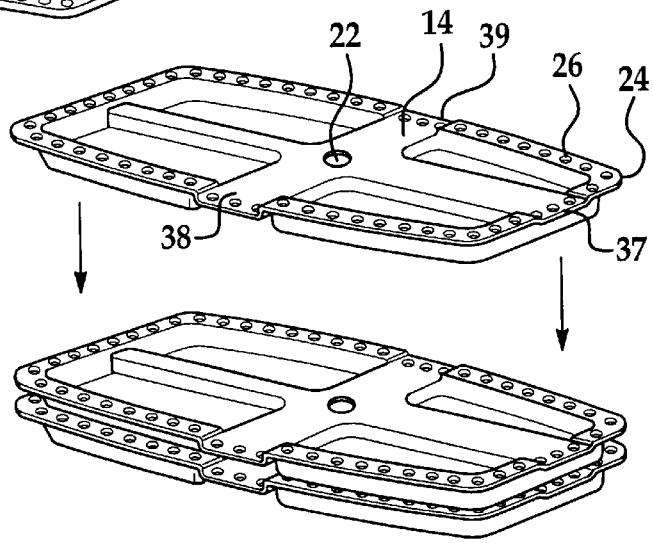
FIG. 4 is a perspective view of a plurality of generally flat base members and their respective stacking capability.

Portable floatation assembly 10 further includes a plurality of generally flat and rectangular base portions 14, which are substantially identical in shape and dimension to the rim portion 28 of the body 12. In the preferred embodiment of the present invention, base 14 is integrally formed from the same material as generally hollow body 12. Base portion 14 includes an elevated border portion 24 which extends out from and around the entire top perimeter of base portion 14. Elevated border portion 24 of base portion 14 further includes a plurality of apertures 26 which are disposed along the periphery of border portion 24, and which are substantially identical in shape, size, and location to the apertures 30 of generally hollow body 12 (i.e., when the bottom edge 27 of body 12 is disposed on top of border portion 24, each individual aperture 30 is substantially aligned with a matching aperture 26). As is best shown in FIG. 4, elevated border portion 24 further includes connector depressions 37–39 which selectively receive stabilizing connectors 120, as is also further discussed below. Base portion 14 further includes an aperture 22 located approximately in the center of base portion 14, which selectively and frictionally receives conduit segment 17 of conduit 16, as is further discussed below.

Portable floatation assembly further includes a plurality of generally rectangular stabilizing connectors 120, which are formed to sealingly fit within the aperture formed by depressions 37–39 when a body 12 is disposed on top of a base 14 to form an individual floatation device 44. Connectors 120 are formed from a material such as a polymer or metal which is effective to rigidly couple each device 44 together to form floatation assembly 10 such that, members 120 substantially prevent devices 44 from moving away from each other (e.g., in the directions of arrows 40–43). Stabilizing connectors 120 include a plurality of apertures 121 disposed along the entire length of connector 120, which cooperate with apertures 26, 30, and permits a user to selectively couple body 12, base 14 and connector 120 together in a manner discussed further below. Importantly, connectors 120 are of sufficient length to permit a user to selectively couple floatation devices 44 together in a fashion to elevate watercraft 20 of various sizes and/or shapes, by aligning different apertures 121 with apertures 26, 30.

Portable floatation assembly 10 further includes a plurality of conduits 16 which are removably coupled to an air pump 18. In one non-limiting embodiment, conduits 16 may include a length of pipe having a conventional male coupling at one end and a conventional female coupling at the opposite end to permit individual conduits 16 to be frictionally coupled (e.g., to one another to form a conduit frame 38). As best shown in FIG. 1, conduits 16 are disposed beneath each base portion 14 and substantially "run" beneath the connecting members 120 which couple individual floatation devices 44 together. Conduits 16 further include conduit segments 17, which as discussed above, frictionally couple conduit 16 to base: portions 14 through aperture 22. In one nonlimiting embodiment, aperture 22 may further comprise a rubber "O-ring" or substantially any other desired conventional sealing device, effective to sealingly couple conduit segments 17 to base portion 14, through aperture 22. When coupled together to form frame 38, conduits 16, 17 cooperatively act to communicatively couple air pump 18 to each individual flotation device 44.

In operation, a user seeking to elevate a watercraft 20 creates a plurality of individual floatation devices 44 by pairing a unique one of body 12 to a unique one of body 14 and aligning apertures 30 with. apertures 26. Connection members 120 are then disposed within connection depressions 37–39 in a manner which permits alignment of apertures 121 with apertures 26, 30 while permitting a user to selectively increase or decrease the length and/or width of floatation assembly 10 as desired (i.e., to conform to the shape and dimensions of the hull 21 of a particular watercraft 20). Once devices 44 and connection member 120 are disposed in a desired pattern, the user then selectively and sealingly couples body 12, base 14 and member 120 together through apertures 30, 26, and 121 in a conventional manner (e.g., by selectively "threading" a rope or line through each aperture 30, 26, 121), which utilizes the natural force of water pressure to create an airtight seal (i.e., the natural water pressure in any given body of water will apply a force upon the device. 44 creating an airtight seal, thereby reducing the likelihood of an air leak from device 44).

Conduits 16 and conduit segments 17 are then coupled together to form a conduit frame 38 which is substantially the same shape as the desired pattern formed by devices 44 and connection members 120 and are disposed beneath devices 44 and members 120. Conduit segments are then sealingly and frictionally coupled to each device 44 through central aperture 22, effective to couple each floatation device 44 to air pump 18.

Figure 2:
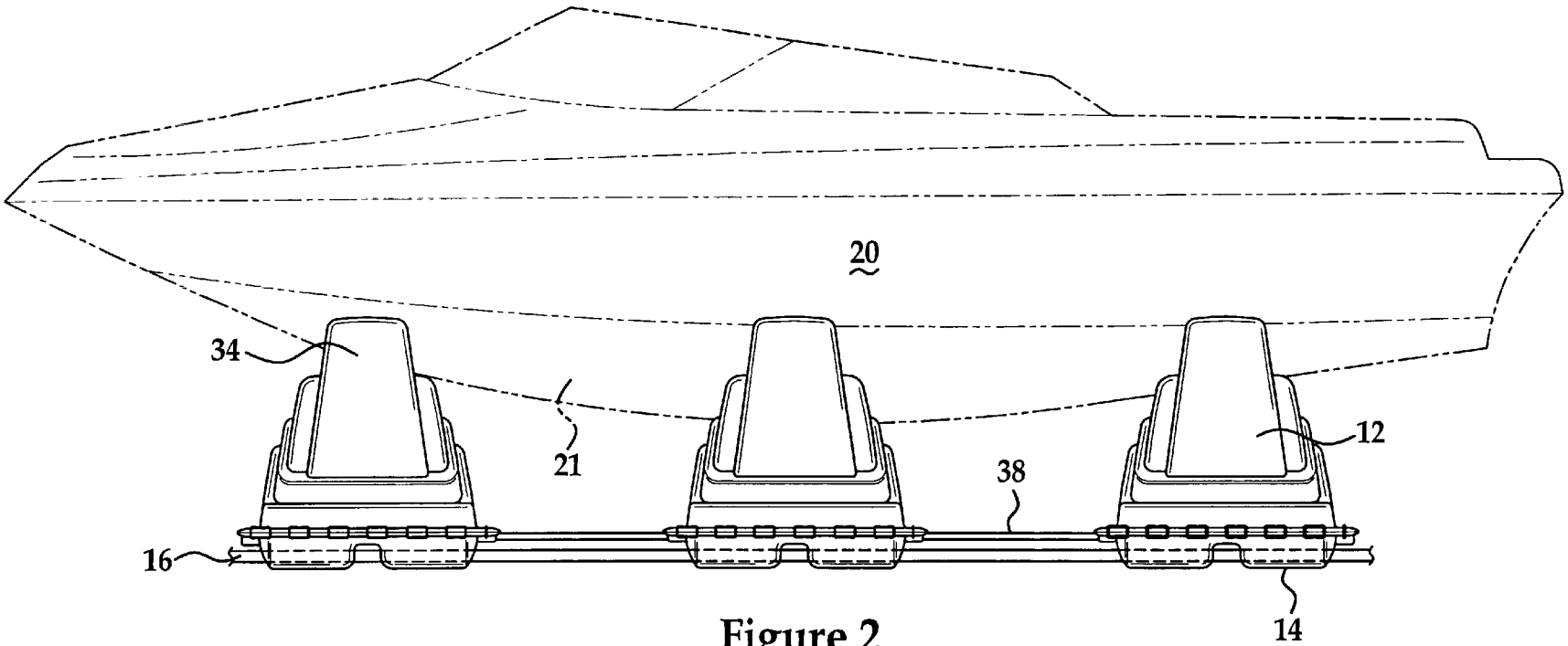
FIG. 2 is a side view of the assembly shown in FIG. 1 in combination with a watercraft.

Floatation assembly 10 is then placed beneath watercraft 20, as best shown in FIG. 2 and air pump 18 selectively displaces a volume of air through conduits 16, 17 and into generally hollow cavity 55 of floatation devices 44. Air pump 18 increases the atmospheric pressure within each device 44 effective to increase the buoyancy of assembly 10. Watercraft 20 is effectively and conveniently lifted by assembly 10 as the buoyancy level of assembly 10 is progressively increased.

It should be understood that this invention is not limited to the exact construction or embodiments listed and described, but that various changes may be made without departing from the spirit and scope of the invention. For example, and without limitation, floatation devices 44 may be of substantially any shape or size depending upon the amount of buoyancy needed or watercraft type.

What is claimed is:

1. A flotation device comprising a plurality of substantially identical and rectangular generally hollow bodies, a plurality of substantially identical base portions, a plurality of conduits, and an air pump.

2. The floatation device of claim 1, wherein said plurality of substantially identical and rectangular generally hollow bodies further comprise a plurality of substantially identical grooves formed in a top middle portion of said generally hollow bodies.

3. The floatation device of claim 2, wherein said plurality of substantially identical and rectangular generally hollow bodies further comprise a rim portion along a bottom edge of each of said hollow bodies, said rim portion further includes a plurality of apertures disposed along the periphery of said rim portion.

4. The floatation device of claim 3, wherein said plurality of substantially identical base portions further comprise an elevated border portion having a plurality of apertures which are disposed along the periphery of said border portion.

5. The floatation device of claim 4, wherein said plurality of substantially identical base portions further comprises an aperture which permits said plurality of conduits to be coupled to said base portion.

6. The floatation device of claim 1, wherein a unique one of said plurality of substantially identical and rectangular generally hollow bodies is selectively coupled to a unique one of said plurality of substantially identical base portions.

7. The floatation device of claim 1, wherein said pump is a manual hand pump.

8. A portable floatation device for elevating a watercraft above a water line, said floatation device comprising of a plurality of generally hollow bodies having a curved top surface, a serrated middle portion which frictionally engages said watercraft, and a rim having a plurality of first apertures; a plurality of generally flat base members having a plurality of second apertures; a plurality of connection members having a plurality of third apertures; a plurality of conduits; and a manually powered air pump.

9. The floatation device of claim 8, wherein said plurality of generally hollow bodies and said plurality of generally flat base members are selectively stackable.

10. The floatation device of claim 8, wherein said generally hollow bodies each further comprise a projected retention member which cooperates with said serrations to frictionally engage said watercraft.

11. The floatation device of claim 9, wherein said plurality of generally hollow bodies and said plurality of generally flat base portions are further removably coupled.

12. The floatation device of claim 8, wherein said plurality of conduits are further removably coupled to said manually powered pump.

13. The floatation device of claim 12, wherein said base portion further includes a fourth aperture disposed through a bottom portion of said base portion, and wherein said plurality of conduits are further frictionally and removably coupled through said fourth aperture of said plurality of generally flat base portions.

14. A method for raising a watercraft having a hull portion out of a body of water, said method comprising the steps of:

forming a plurality of stackable and generally hollow body portions forming a plurality of stackable and generally flat base portions;

providing a plurality of conduits;

providing a pumping device;

coupling said pumping device to said conduits, coupling said conduits to said base portions, and coupling said generally hollow body portions to said base portions, effective to form a plurality of floatation members;

placing said plurality of floatation members beneath said hull portion of said watercraft; and causing said pumping device to displace a volume of air into each of said plurality of floatation members, effective to raise said watercraft out of said body of water.

15. The method of claim 14, wherein said step of forming said generally hollow body portions further comprises the steps of:

forming a middle portion having a serrated surface which frictionally engages said hull portion; and forming a rim portion having a plurality of apertures disposed along the periphery of said rim portion.

16. The method of claim 15, wherein said step of forming said generally flat base portions further comprises the steps of:

forming an aperture through the center of said generally flat base portion; and forming an elevated border portion having a plurality of apertures disposed along the periphery of said elevated border portion.

17. The method of claim 16, wherein said step of providing a plurality of conduits further comprises the step of:

selectively and removably coupling said conduits to each other, effective to form a conduit frame and which permits air to be selectively communicated from said pumping device into said floatation members.

18. The method of claim 17, wherein said step of coupling said pumping device to said conduits further comprises the steps of:

selectively and removably coupling said pumping device to a connector portion, which selectively and removably couples said pumping device to said conduit frame; and frictionally and removably coupling said floatation members to said conduit frame, effective to form a portable watercraft floatation apparatus.

* * * * *